US007503272B2

(12) United States Patent
Park

(10) Patent No.: US 7,503,272 B2
(45) Date of Patent: Mar. 17, 2009

(54) RACK AND PINION TYPE POWER TRANSMISSION AND APPARATUS FOR DRIVING EMBROIDERY FRAME OF EMBROIDERY MACHINE HAVING THE SAME

(75) Inventor: Chan Soo Park, Seoul (KR)

(73) Assignee: Sunstar Precision Co., Ltd., Incheon (KR)

( * ) Notice: Subject to any disclaimer, the term of this patent is extended or adjusted under 35 U.S.C. 154(b) by 0 days.

(21) Appl. No.: 11/753,593

(22) Filed: May 25, 2007

(65) Prior Publication Data

US 2008/0105178 A1 May 8, 2008

(30) Foreign Application Priority Data

Nov. 3, 2006 (KR) ..... 10-2006-0108452
Jan. 17, 2007 (KR) ..... 10-2007-0005456

(51) Int. Cl.
*D05B 21/00* (2006.01)
*D05B 69/30* (2006.01)

(52) U.S. Cl. ..... 112/470.18

(58) Field of Classification Search ..... 112/102, 112/118, 103, 470.06, 470.09, 470.14, 470.18, 112/475.18
See application file for complete search history.

(56) References Cited

U.S. PATENT DOCUMENTS 3,750,186 A * 7/1973 Sakamoto ..... 346/33 MC
4,365,564 A * 12/1982 Sugiyama ..... 112/470.06
4,386,573 A * 6/1983 Davidson et al. ..... 112/103
4,406,234 A * 9/1983 Johnson et al. ..... 112/470.18
4,510,875 A * 4/1985 Peck ..... 112/470.04
4,602,578 A * 7/1986 Yokoe et al. ..... 112/470.18
5,127,348 A * 7/1992 Scholl et al. ..... 112/470.18

* cited by examiner

*Primary Examiner*—Ismael Izaguirre
(74) *Attorney, Agent, or Firm*—Harness, Dickey & Pierce, PLC

(57) ABSTRACT

Disclosed are a rack and pinion type power transmission and a driving apparatus of an embroidery frame of an embroidery machine having the same. The gear teeth, which are engaged with the engaging member connected to the power source, are formed in the lower side of the a single movable frame, to which the embroidery frame is fixed, so as to directly move the movable frame, so that uniform driving force is transmitted to the embroidery frame during the movements of the embroidery frame. Thus, the high reliable and steady movement is performed. The driving apparatus includes any one of the X- and Y-directional movement mechanisms. The mechanism includes a fixed frame installed to a beam-body of the sewing machine, a movable frame movably installed on the fixed frame and having gear teeth, and a movable frame movement mechanism engaged with the gear teeth to reciprocate the movable frame.

36 Claims, 13 Drawing Sheets

FIGURE 1
PRIOR ART
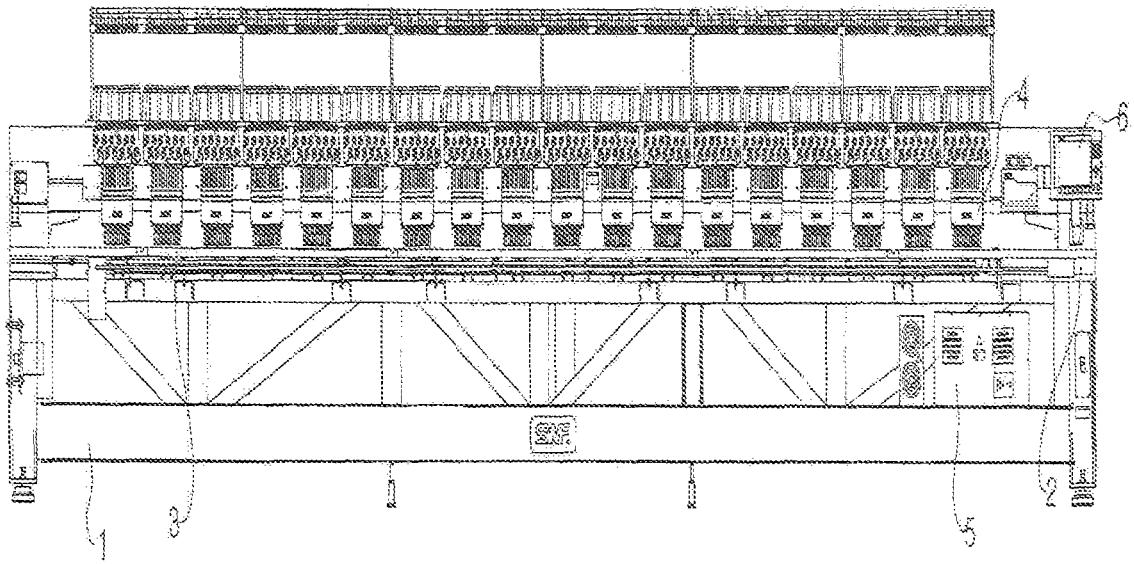
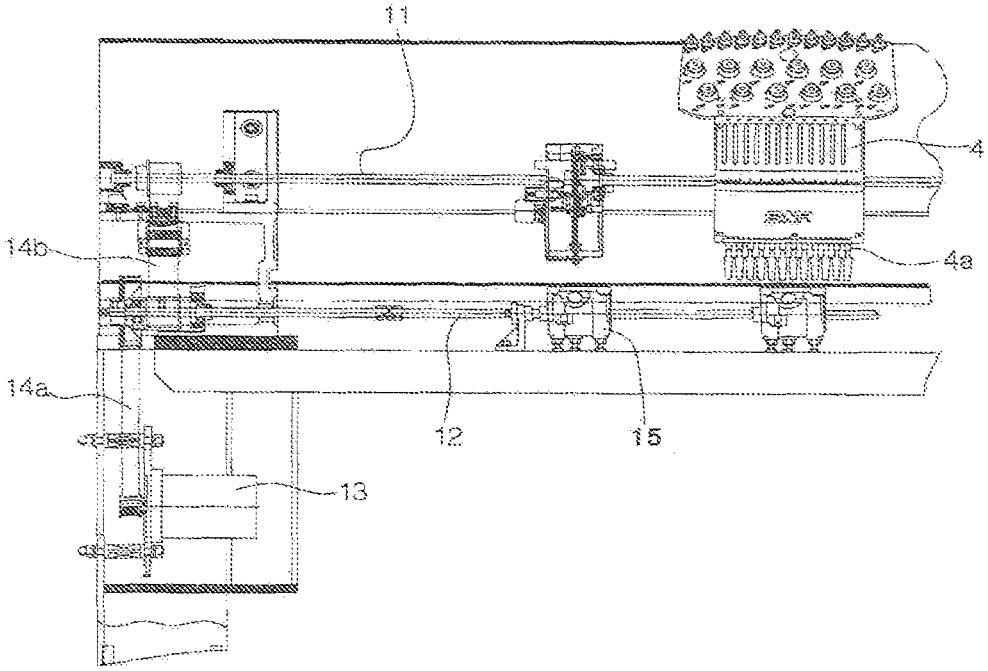
FIGURE 2
PRIOR ART

RACK AND PINION TYPE POWER TRANSMISSION AND APPARATUS FOR DRIVING EMBROIDERY FRAME OF EMBROIDERY MACHINE HAVING THE SAME

FIELD

The present invention relates to a rack and pinion type power transmission, and more particularly, to a rack and pinion type power transmission using a timing belt having gear teeth engaged with gear teeth of a rack to precisely control a transmission of a driving force.

Moreover, the present invention relates to a driving apparatus of an embroidery frame of an embroidery machine having a rack and pinion type power transmission, and more particularly, to a driving apparatus of an embroidery frame of an embroidery machine in which a rack and pinion type power transmission is used to move a movable frame of an embroidery frame installed to one fixed frame so that an uniform driving force can be transmitted to overall the embroidery frame, inferior embroidery caused by vibration of the embroidery frame during the transfer can be prevented, and a high-speed operation is enabled.

DESCRIPTION OF THE PRIOR ART

As generally known in the art, there are an embroidery machine and a sewing machine as sewing machines. The embroidery machine represents a machine in which a sewing needle bar moves up and down and an embroidery frame, to which a workpiece fabric is fixed, and travels in the X-axis direction and the Y-axis direction to embroider as a user wishes. The sewing machine is usually used in home.

There is a difference between the sewing machine and the embroidery machine in view that the sewing machine moves the workpiece fabric by a saw tooth-shaped mover and sews the workpiece fabric and the embroidery machine transfers the embroidery frame to hold the workpiece fabric in the X-axis direction and the Y-axis direction to embroider the workpiece fabric.

In the embroidery machine, since the embroidery frame to hold the workpiece fabric moves in the X-axis direction and the Y-axis direction to embroider the workpiece fabric, the precise movement and a constant speed of the embroidery frame are closely connected to the quality of the embroidery.

Accordingly, a servo motor or an induction motor capable of controlling speed is used as a driving unit to move the needle bar of the embroidery machine up and down, a stepping motor which has an excellent positioning function and is easy to control is usually used as a driving unit to move the embroidery machine in the X-axis direction and the Y-axis direction.

There are several types of the embroidery machine such as a single head type automatic embroidery machine, a multi-head type automatic embroidery machine having two or more heads, and a special embroidery machine such as a computer quilting machine.

Hereinafter, configuration and operation of the conventional embroidery machine will be described with reference to the accompanying drawings.

FIG. 1 is an external appearance of a conventional multi-head type automatic embroidery machine, and FIG. 2 is a view illustrating a head and a shuttle driving unit of the embroidery machine in FIG. 1.

The multi-head type automatic embroidery machine, as illustrated in FIGS. 1 and 2, includes a beam-body 1 to support the embroidery machine, a table 2 installed on the beam-body 1, an embroidery frame (or an embroidery table) 3 installed on the table 2 to fix cloth to be embroidered, a plurality of heads 4 installed on an upper shaft 11 upper than the embroidery frame 3 to perform the embroidery, a shuttle (or a hook) 15 installed on a lower shaft 12 lower than the table 2 to face the heads 4 and to feed a lower thread, a main controller box 5 installed at the lower side of the table 2, and a manipulation panel 6 installed at a side of the table 2. A main shaft driving motor 13 is installed at a lower side of the table 2. A first belt 14*a* connects a rotation shaft of the main shaft driving motor 13 and the lower shaft 12, and the lower shaft 12 and the upper shaft 11 is connected to each other by a second belt 14*b*.

Thus, due to the rotation of the main shaft driving motor 13, the lower shaft 12 and the upper shaft 11 rotate. Due to the rotation of the lower shaft 12, the shuttle 15 is driven to feed the lower thread for the embroidery. Due to the rotation of the upper shaft 11, the needle bar 4*a* installed in the head 4 is driven to embroider the cloth.

In order to increase the productivity, the embroidery machine usually includes a plurality of head 4 (for example, 10 to 24 heads). The plural heads 4 are connected to each other by a signal rotation shaft (upper shaft), each of the heads 4 has a plurality of needles (for example, 6 to 15 needles), and different colored various threads are connected to the respective needles. Thus, the heads 4 embroider the cloth using various colored threads according to a desired embroidery pattern.

FIGS. 3 and 4 are a perspective view and a plane view illustrating a driving apparatus of an embroidery frame of the conventional multi-head type automatic embroidery machine.

The driving apparatus of the embroidery frame of the conventional multi-head type automatic embroidery machine, as illustrated in FIGS. 3 and 4, includes a table 2 to which an object to be embroidered is placed, and an embroidery frame 3 installed at the upper side of the table 2 to fix the object to be embroidered. In this case, the embroidery frame 3 includes a pair of elongated horizontal frames 3*a* and a pair of a vertical frames 3*b*, installed at the upper side of the table 2, to support the object to be embroidered, and has a rectangular shape. In the lower side of the table 2, an X-movement mechanism 20 and a Y-directional movement mechanism 30 are installed to move the embroidery frame 3 in the X-direction and in the Y-direction.

In this case, the Y-directional movement mechanism 30, as illustrated in FIG. 5, is installed on a timing belt 52 arranged long in the longitudinal direction. When the timing belt 52 is rotated by a Y-axis driving motor 50 to drive the Y-directional movement mechanism 30, a bearing block (not shown) engaged with the timing belt 52 moves along a guide rail 31 embedded in Y-axis frames 30*a* and 30*b* in the Y-axis direction (upward and downward). Since the embroidery frame 3 is installed on a bearing block connecting cover 40 having the bearing block installed therein, the embroidery frame 3 moves in the Y-axis direction (upward and downward) according to the movement of the bearing block.

The X-directional movement mechanism 20 is installed on a timing belt (not shown) arranged long in the horizontal direction. When the timing belt is rotated by an X-axis driving motor (not shown) to drive the X-directional, a bearing block (not shown) engaged with the timing belt moves along a guide rail embedded in X-axis frames (not shown) in the Y-axis direction (rightward and leftward). Since the embroidery frame 3 is installed on a bearing block connecting cover (not shown and see 40 in FIG. 5) having the bearing block installed therein, the embroidery frame 3 moves in the X-axis direction (rightward and leftward) according to the movement of the bearing block.

An object to be embroidered or other object is placed on and fixed to the embroidery frame 3 by a worker, and the worker reads desired embroidery design data from the exterior, that is, a floppy disc, a hard disc, or the like through the manipulation panel 6 to perform the embroidery. Then, the X-directional movement mechanism 20 and the Y-directional movement mechanism 30 move the embroidery frame 3 in the X- and Y-axis directions based on the embroidery design data.

In more detail, an X-axis driving motor (not shown) of the X-directional movement mechanism 20 rotates forward and backward in accordance with X-axis movement data, and the forward and backward driving force of the X-axis driving motor is transmitted to the embroidery frame 3 via the timing belt such that the embroidery frame 3 moves rightward and leftward. In other words, the X-axis bearing block connected to the embroidery frame 3 is installed at a predetermined position of the timing belt and the embroidery frame 3 is placed on the X-axis bearing block so that the embroidery frame 3 is installed to move in the X-axis direction (rightward and leftward) along the guide rail embedded in the X-axis frame.

Meanwhile, the Y-axis driving motor 50 of the Y-directional movement mechanism 30, as illustrated in FIG. 5, rotates forward and backward in accordance with Y-axis movement data, and the forward and backward driving force of the Y-axis driving motor is transmitted to the embroidery frame 3 via the timing belts 51 and 52 such that the embroidery frame 3 moves forward and backward. In other words, the Y-axis bearing block connected to the embroidery frame 3 is installed at a predetermined position of the timing belt 52 and the embroidery frame 3 is placed on the Y-axis bearing block so that the embroidery frame 3 is installed to move in the Y-axis direction (forward and backward) along the guide rail 31 embedded in the Y-axis frames 30*a* and 30*b*.

Moreover, the Y-axis frames 30*a* and 30*b*, to which a front side and a rear side of the embroidery frame 3 are fixed in order to expand the Y-axis directional movement range of the embroidery frame 3, are divided into a front Y-axis frame 30*a* and a rear Y-axis frame 30*b*. Front and rear Y-axis bearing blocks (not shown) are installed in the front and rear Y-axis frames 30*a* and 30*b* to move along the guide rails embedded in the front and rear Y-axis frames 30*a* and 30*b* in the Y-axis direction (forward and backward). In this case, the front and rear Y-axis bearing blocks are connected to the bearing block connecting cover 40 and the embroidery frame 3 is placed on the bearing block connecting cover 40. The timing belt 52, as illustrated in FIG. 5, is installed on only the Y-axis frame 30*b* positioned at the rear side of the embroidery frame 3, and the Y-axis bearing block installed in the bearing block connecting cover 40 is coupled with the timing belt 52 to move.

However, in the driving apparatus of an embroidery frame of the conventional multi-head type automatic embroidery machine constructed as described above, when the movement range of the embroidery frame 3 is increase, the length of the timing belt 52 should be increased in the Y-axis direction. When the length of the timing belt 52 is elongated in the Y-axis direction, vibration is easily generated during the movement of the Y-axis bearing block.

Moreover, the driving apparatus of an embroidery frame of the conventional multi-head type automatic embroidery machine includes the Y-axis frame 30*b* in which the timing belt 52 is installed and the Y-axis frame 30*a* in which the guide rail 31 is installed, and one of the bearing block connecting covers 40 is installed long on the Y-axis frames 30*a* and 30*b*. In this case, if strength of the bearing block connecting cover 40 is not enough, since the supporting force of the bearing block connecting cover 40 positioned at the Y-axis frame 30*a* is relatively weak in comparison to it of the bearing block connecting cover 40 positioned at the Y-axis frame 30*b* to directly receive the driving force from the timing belt 52, vibration is generated during the forward movement of the embroidery frame 3 to make the quality of the embroidery product be inferior.

Moreover, since the driving apparatus of an embroidery frame of the conventional multi-head type automatic embroidery machine is configured to move the embroidery frame 3 by the timing belt 52, a slip is generated during the transmission of the driving force of the timing belt 52 or the timing belt 52 is loosened. In this case, since the driving force is not precisely transmitted, all the movement mechanism must be dissembled to replace the timing belt 52. Thus, it is complicated and unnecessary time and costs are required.

SUMMARY

Accordingly, the present invention has been made to solve the above-mentioned problems occurring in the prior art, and it is an aspect of the present invention to provide a rack and pinion type power transmission for precisely controlling a power transmission using a timing belt having gear teeth engaged with gear teeth of a rack.

It is another aspect of the present invention to provide a driving apparatus of an embroidery frame of a sewing machine having a rack and pinion type power transmission.

It is still another aspect of the present invention to provide a driving apparatus of an embroidery frame of a sewing machine for transmitting a uniform movement driving force to the front and rear sides of an embroidery frame to increase a driving reliability during the movement of the embroidery frame.

Moreover, it is still another aspect of the present invention to provide a driving apparatus of an embroidery frame of a sewing machine for moving a movable frame of the embroidery frame installed in a single fixing frame using a rack and pinion type power transmission so that a uniform movement driving force is transmitted to overall embroidery frame, the quality of the embroidery can be prevented from deteriorating due to vibration of the embroidery frame during the movement, and a high-speed operation is enabled.

In accordance with an aspect of the present invention, there is provided a driving apparatus of an embroidery frame of a sewing machine comprising: at least one X-directional movement mechanism to move the embroidery frame to support an object to be embroidered in right-to-left direction (X-direction); and at least one Y-directional movement mechanism to move the embroidery frame to support an object to be embroidered in front-to-rear direction (Y-direction), wherein one of the X-directional movement mechanism and the Y-directional movement mechanism comprises: a fixed frame installed to a beam-body of the sewing machine; a movable frame movably installed on the fixed frame and having gear teeth; and a movable frame movement mechanism engaged with the gear teeth formed in the movable frame to reciprocate the movable frame.

In accordance with another aspect of the present invention, there is provided a driving apparatus of an embroidery frame of a sewing machine comprising: at least one X-directional movement mechanism to move the embroidery frame to support an object to be embroidered in right-to-left direction (X-direction); and at least one Y-directional movement mechanism to move the embroidery frame to support an object to be embroidered in front-to-rear direction (Y-direction), wherein each of the X-directional movement mechanism and Y-directional movement mechanism comprises: a fixed frame installed to a beam-body of the sewing machine; a movable frame movably installed on the fixed frame and having gear teeth; and a movable frame movement mechanism engaged with the gear teeth formed in the movable frame to reciprocate the movable frame.

The fixed frame includes a guide rail formed long along a longitudinal shaft on the upper side of the fixed frame, and the fixed frame comprises a plurality of track rollers provided at the lateral sides by a regular interval.

The fixed frame further comprises an insertion hole into which the movable frame movement mechanism is inserted to be engaged with the movable frame.

The movable frame comprises: guide rails installed long along the longitudinal axis at the lateral sides of the movable frame to be supported and moved by the track rollers of the fixed frame; and a rail guide member installed in the upper side of the movable frame to guide the embroidery frame in the direction perpendicular to the movable frame.

The rail guide member is a roller.

Moreover, the movable frame comprises: a plurality of track rollers provided at the lateral sides of the movable frame by a regular interval; and a rail guide member installed in the upper side of the movable frame to guide the embroidery frame in the direction perpendicular to the movable frame.

The fixed frame comprises: guide rails installed long along the longitudinal axis at the lateral sides of the fixed frame to be supported and moved by the track rollers of the movable frame; and an insertion hole into which the movable frame movement mechanism is inserted to be engaged with the movable frame.

The rail guide member is a roller.

The movable frame movement mechanism comprises: an engaging member engaged with the gear teeth formed in the lower side of the movable frame; a plurality of rotation members to rotatably support the engaging member; and a driving body to provide a rotational force to the engaging member.

The plurality of rotation members supports the engaging member, the driving body is positioned between rotation members among the plural rotation members installed at the positions higher than rotation shafts of the rotation members positioned at the lower side and at the lower side, and the engaging member has a reversed U-shape formed by the driving body installed between the two rotation members.

The engaging member comprises a belt-type member.

The belt type member includes gear teeth engaged with the gear teeth formed in the movable frame.

The plurality of rotation members comprises idlers.

The driving body comprises gear teeth engaged with the engaging member.

The engaging member comprises a chain-type member.

The movable frame movement mechanism comprises: an engaging member engaged with the gear teeth formed in the lower side of the movable frame; and a driving body to provide a rotational force to the engaging member.

The engaging member comprises a pinion.

In the driving apparatus, front and rear horizontal frames are coupled with a side of the movable frame.

The driving apparatus further comprises one of an X-directional frame driving unit provided at a side of the movable frame of the X-directional movement mechanism to move the embroidery frame in the X-direction, and a Y-directional frame driving unit provided at a side of the movable frame of the Y-directional movement mechanism to move the embroidery frame in the Y-direction.

The driving apparatus further comprises an X-directional frame driving unit provided at a side of the movable frame of the X-directional movement mechanism to move the embroidery frame in the X-direction; and a Y-directional frame driving unit provided at a side of the movable frame of the Y-directional movement mechanism to move the embroidery frame in the Y-direction.

The driving apparatus further comprises an X-directional frame driving unit to move the embroidery frame in the X-direction by the movable frame of the X-directional movement mechanism; a Y-directional frame driving unit to move the embroidery frame in the Y-direction by the movable frame of the Y-directional movement mechanism; an X-Y-directional frame driving unit connected to the X-directional movement mechanism and the Y-directional movement mechanism to move the embroidery frame in the X-direction and in the Y-direction; and a connecting body connected to the X-Y-directional frame driving unit to detachably fix the embroidery frame.

The driving apparatus further comprises a Y-directional frame driving unit provided at a side of the movable frame of the Y-directional movement mechanism to move the embroidery frame in the Y-direction; an X-directional frame driving unit provided at a side of the Y-directional frame driving unit to be moved in the Y-direction and to move the embroidery frame in the X-direction; and a connecting body connected to the movable frame of the X-directional movement mechanism to detachably fix the embroidery frame.

The movable frame driving unit is installed in the upper side of the sewing table at the central area of the movable frame of the Y-directional movement mechanism.

The movable frame of the X-directional movement mechanism comprises upwardly formed gear teeth.

The driving apparatus further comprises a fixed frame installed at a side of the movable frame of the Y-directional movement mechanism; an X-directional movement mechanism installed at a side of the fixed frame to be moved in the Y-direction and to move the embroidery frame in the X-direction; and a connecting body connected to the movable frame of the X-directional movement mechanism to detachably fix the embroidery frame.

The movable frame driving unit is installed in the upper side of the sewing table at the central area of the fixed frame.

The movable frame of the X-directional movement mechanism comprises upwardly formed gear teeth.

Individual driving sources are installed to respective movable frame movement mechanisms.

The movable frame movement mechanism is driven by a single driving source.

The movable frame movement mechanism is installed at the intermediate portion in the longitudinal direction of the fixed frame.

The beam-body of the sewing machine comprises a table.

In accordance with an aspect of the present invention, there is provided a power transmission comprising: a rack formed with gear teeth; an engaging member engaged with the gear teeth of the rack; a plurality of rotation member to rotatably support the engaging member; and a driving body to provide a rotational force to the engaging member.

The plurality of rotation members supports the engaging member, the driving body is positioned between rotation members among the plural rotation members installed at the positions higher than rotation shafts of the rotation members positioned at the lower side and at the lower side, and the engaging member has a reversed U-shape formed by the driving body installed between the two rotation members.

The engaging member comprises a belt-type member.

The belt-type member includes gear teeth engaged with the gear teeth formed in the rack.

The plurality of rotation members comprises idlers.

The driving body comprises gear teeth engaged with the engaging member.

The engaging member comprises a chain-type member.

Thus, the movable frame of the embroidery frame installed in a single fixed frame is moved using the rack and pinion type power transmission so that a uniform movement driving force can be transmitted to overall embroidery frame, the deterioration of the quality of the embroidery product due to the vibration of the embroidery frame during the movement can be prevented, and a high-speed operation is enabled.

Further areas of applicability will become apparent from the description provided herein. It should be understood that the description and specific examples are intended for purposes of illustration only and are not intended to limit the scope of the present disclosure.

DRAWINGS

The above and other objects, features and advantages of the present invention will be more apparent from the following detailed description taken in conjunction with the accompanying drawings, in which:

FIG. 1 is a view illustrating an overall external appearance of a conventional multi-head type automatic embroidery machine;

FIG. 2 is a view illustrating a head and a shuttle driving unit of the automatic embroidery machine in FIG. 1;

FIGS. 11 to 14 are views illustrating a driving apparatus of an embroidery frame employed in the embodiments of the present invention, in which:

FIG. 11 is a view illustrating fixed frames, movable frames, and movable frame driving units of an X-directional movement mechanism and a Y-directional movement mechanism;

FIG. 12 is an exploded perspective view illustrating the driving apparatus of an embroidery frame;

FIG. 14 is a view illustrating rack-shaped gear teeth and the movable frame driving unit.

DETAILED DESCRIPTION

Hereinafter, an exemplary embodiment of the present invention will be described with reference to the accompanying drawings.

Embodiment 1

Figure 3:
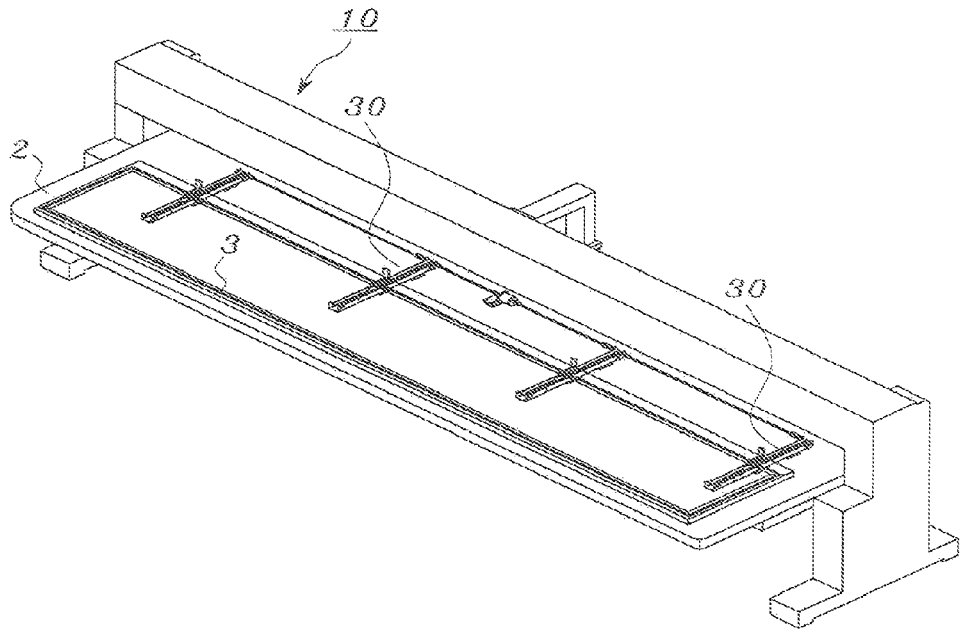
FIGURE 3 PRIOR ART
FIGS. 3 and 4 are a perspective view and a plane view illustrating a driving apparatus of an embroidery frame of the conventional multi-head type automatic embroidery machine.
Figure 4:
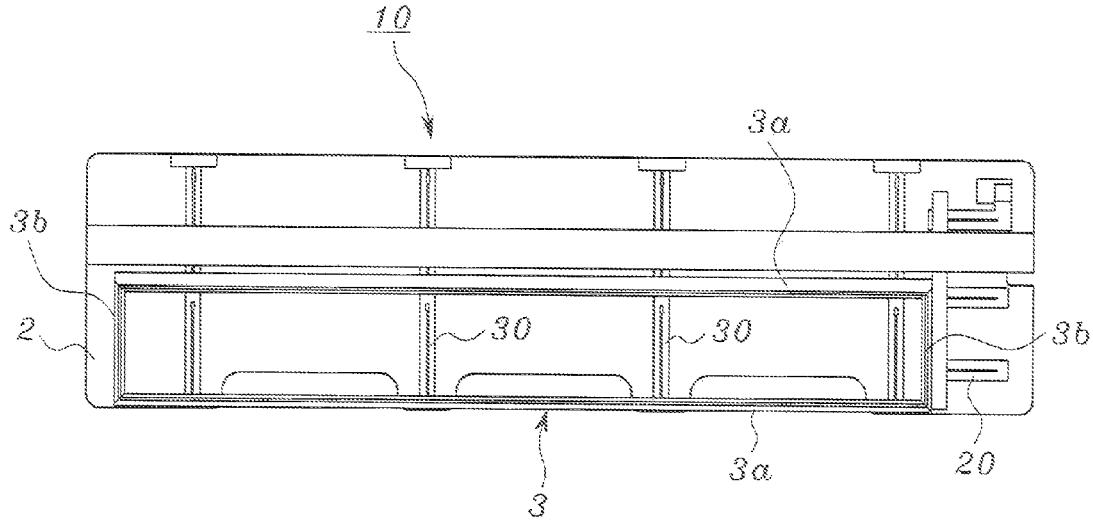
FIGURE 4 PRIOR ART
Figure 5:
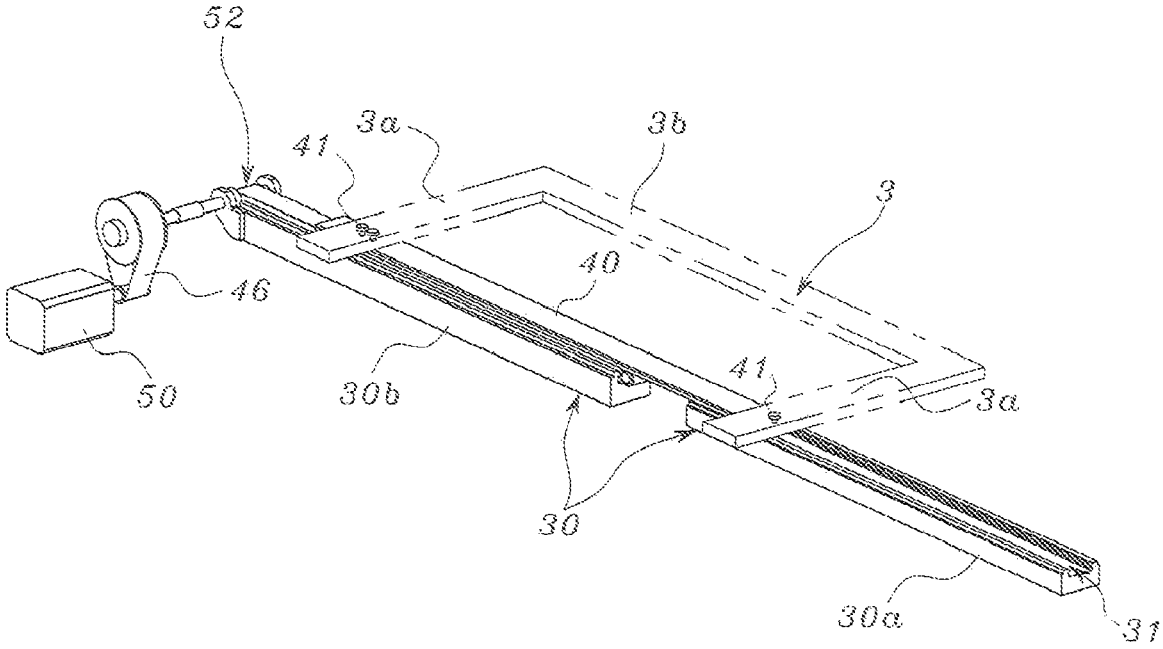
FIGURE 5 PRIOR ART
FIG. 5 is a view illustrating a structure and a drawback of a Y-directional movement mechanism of the driving apparatus of the conventional multi-head type automatic embroidery machine.
Figure 6:
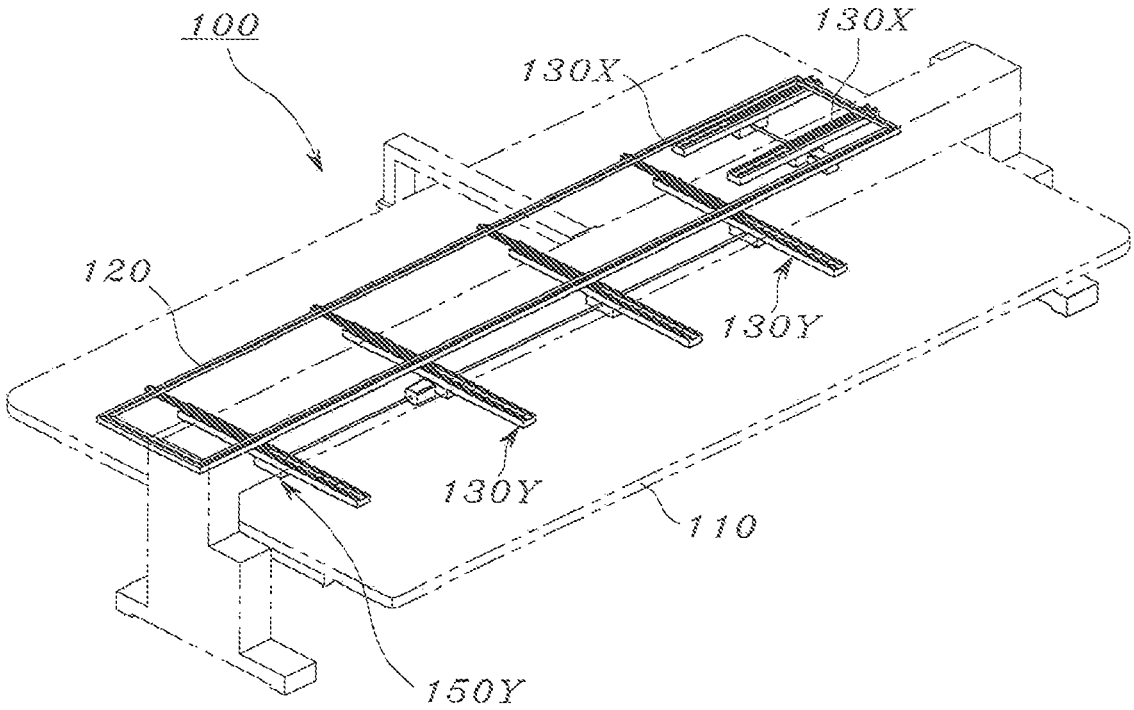
FIG. 6 is a view illustrating a driving apparatus of an embroidery frame of a sewing machine according to a first embodiment of the present invention.

FIG. 6 is a view illustrating a driving apparatus of an embroidery frame of a sewing machine according to a first embodiment of the present invention.

The driving apparatus of an embroidery frame of a sewing machine according to the first embodiment of the present invention is configures as such an embroidery frame 120 is placed on a movable frame 220. As illustrated in FIG. 6, the driving apparatus of an embroidery frame includes at least one X-directional movement mechanism 130X to move the embroidery frame 120 to support an object to be embroidered in the right-to-left direction (X-direction), and at least one Y-direction movement mechanism 130Y to move the embroidery frame 120 in the front-to-rear direction (Y-direction). The X-directional movement mechanism 130X and the Y-directional movement mechanism 130Y will be described in detail later with reference to FIGS. 11 to 14.

Embodiment 2

Figure 7:
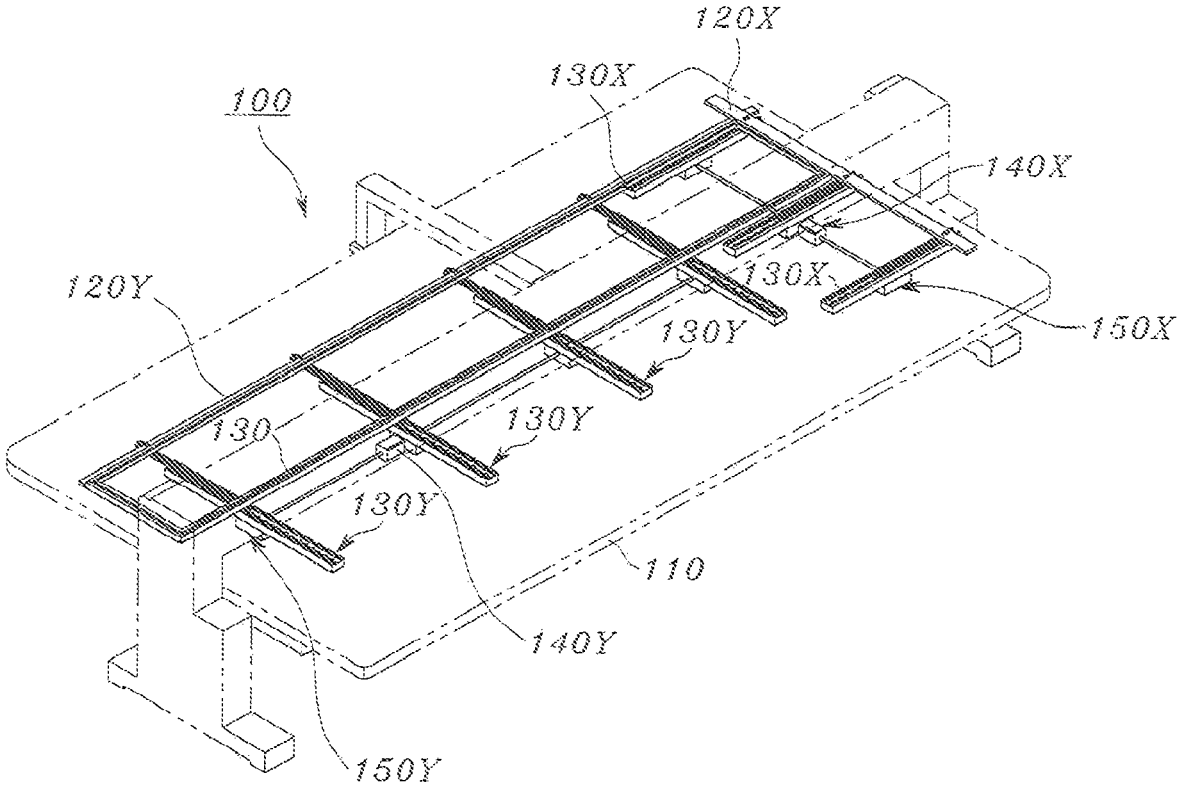
FIG. 7 is a view illustrating a driving apparatus of an embroidery frame of a sewing machine according to a second embodiment of the present invention.

FIG. 7 is a view illustrating a driving apparatus of an embroidery frame of a sewing machine according to a second embodiment of the present invention.

Figure 10:
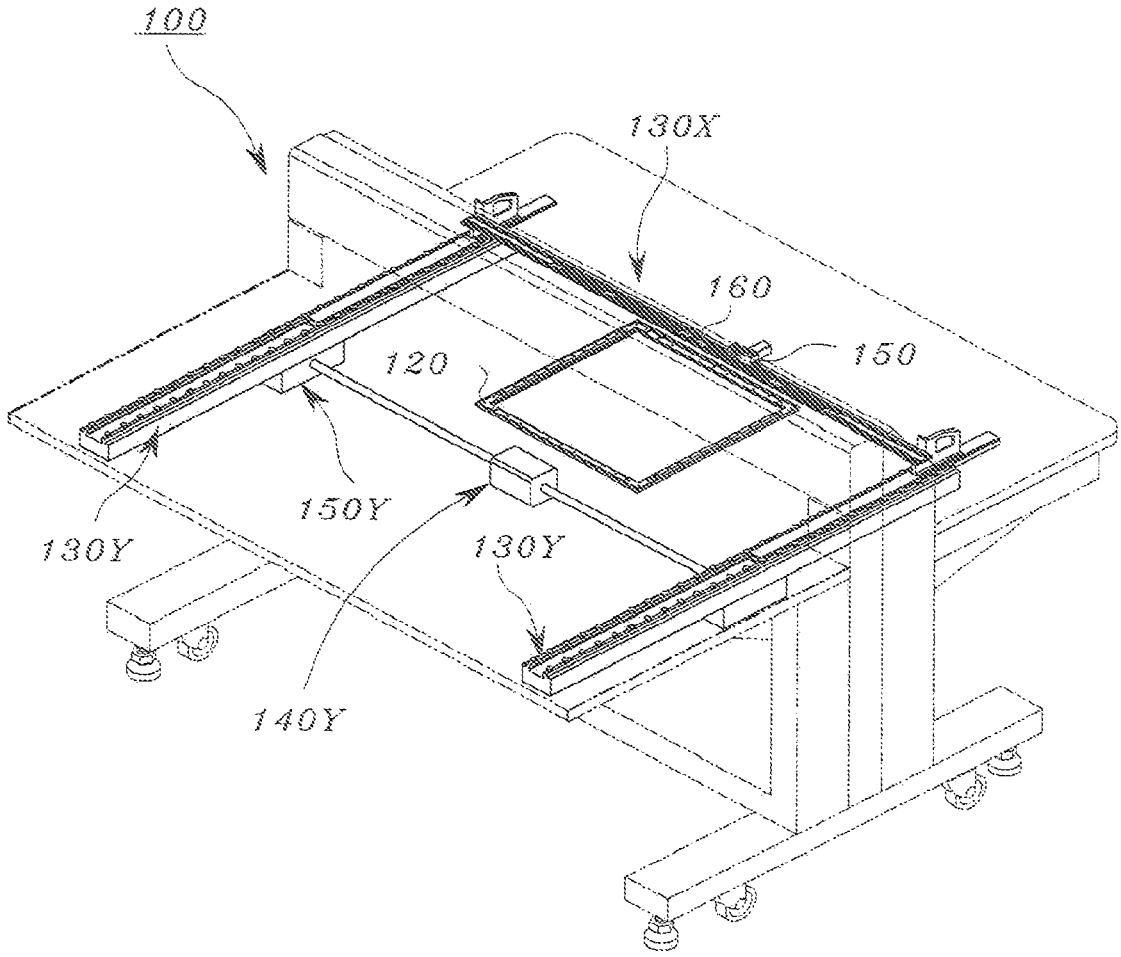
FIG. 10 is a view illustrating a driving apparatus of an embroidery frame of a sewing machine according to a fifth embodiment of the present invention.

The driving apparatus of an embroidery frame of a sewing machine according to the second embodiment of the present invention, as illustrated in FIG. 10, includes at least one X-directional movement mechanism 130X to move the embroidery frame 120 to support an object to be embroidered in the right-to-left direction (X-direction), and at least one Y-direction movement mechanism 130Y installed in the lower side of a sewing table 110 to move the embroidery frame 120 in the front-to-rear direction (Y-direction). The driving apparatus further includes an X-directional frame driving unit 120X installed in the upper side of the movable frame of the X0-directional movement mechanism 130X to move the embroidery frame in the X-direction, and a Y-directional frame driving unit 120Y connected to the X-directional frame driving unit 120X and installed in the upper side of a movable frame of the Y-directional movement mechanism 130Y to move the embroidery frame in the Y-direction. The embroidery frame is configured by coupling a single X-directional frame driving unit 120X with a plurality of the Y-directional frame driving units 120Y.

Meanwhile, the driving apparatus of an embroidery frame according to the embodiment of the present invention, as illustrated in FIG. 7, may be configured by using both of the X-directional frame driving unit 120X and the Y-directional frame driving unit 120Y, or only one of the X-directional frame driving unit 120X and the Y-directional frame driving unit 120Y.

Embodiment 3

Figure 8:
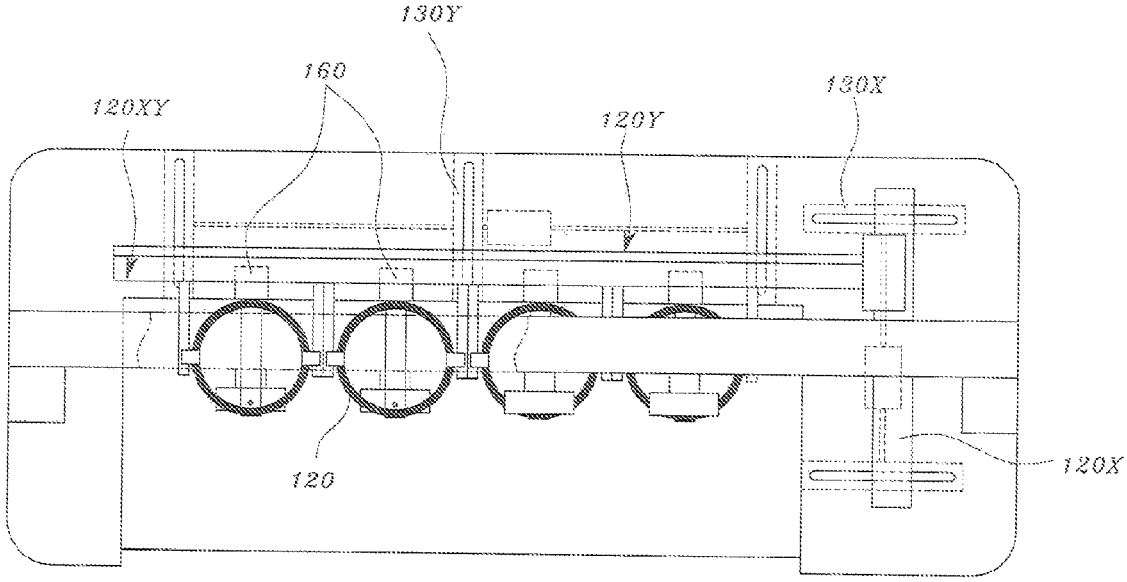
FIG. 8 is a view illustrating a driving apparatus of an embroidery frame of a sewing machine according to a third embodiment of the present invention.

FIG. 8 is a view illustrating a driving apparatus of an embroidery frame of a sewing machine according to a third embodiment of the present invention.

The driving apparatus of an embroidery frame according to the third embodiment of the present invention, as illustrated in FIG. 8, includes an X-directional frame driving unit 120X to move the embroidery frame 120 in the X-direction by the movable frame of the X-directional movement mechanism 130X, a Y-directional frame driving unit 120Y to move the embroidery frame 120 in the Y-direction by the movable frame of the Y-directional movement mechanism 130Y, an X-Y-directional frame driving unit 120XY connected to the X-directional frame driving unit 120X and the Y-directional frame driving unit 120Y to move the embroidery frame 120 in the X-direction or in the Y-direction, and a connecting body 160 connected to the X-Y-directional frame driving unit 120XY to detachably fix the embroidery frame 120.

In this case, the X-directional frame driving unit 120X is installed in the upper side of the movable frame of the X-directional movement mechanism 130X to move the embroidery frame 120 in the X-direction, and the Y-directional frame driving unit 120Y is installed in the upper side of the movable frame of the Y-directional movement mechanism 130Y to move the embroidery frame 120 in the Y-direction. Moreover, the X-Y-directional frame driving unit 120XY connected to the X-directional frame driving unit 120X and the Y-directional frame driving unit 120Y to move the embroidery frame 120 in the X-direction or in the Y-direction. In this case, the embroidery frame 120 is detachably installed to the connecting body 160 installed in the X-Y-directional frame driving unit 120XY, and one or more embroidery frames 120 may be installed in the upper side of the sewing table.

Embodiment 4

Figure 9:
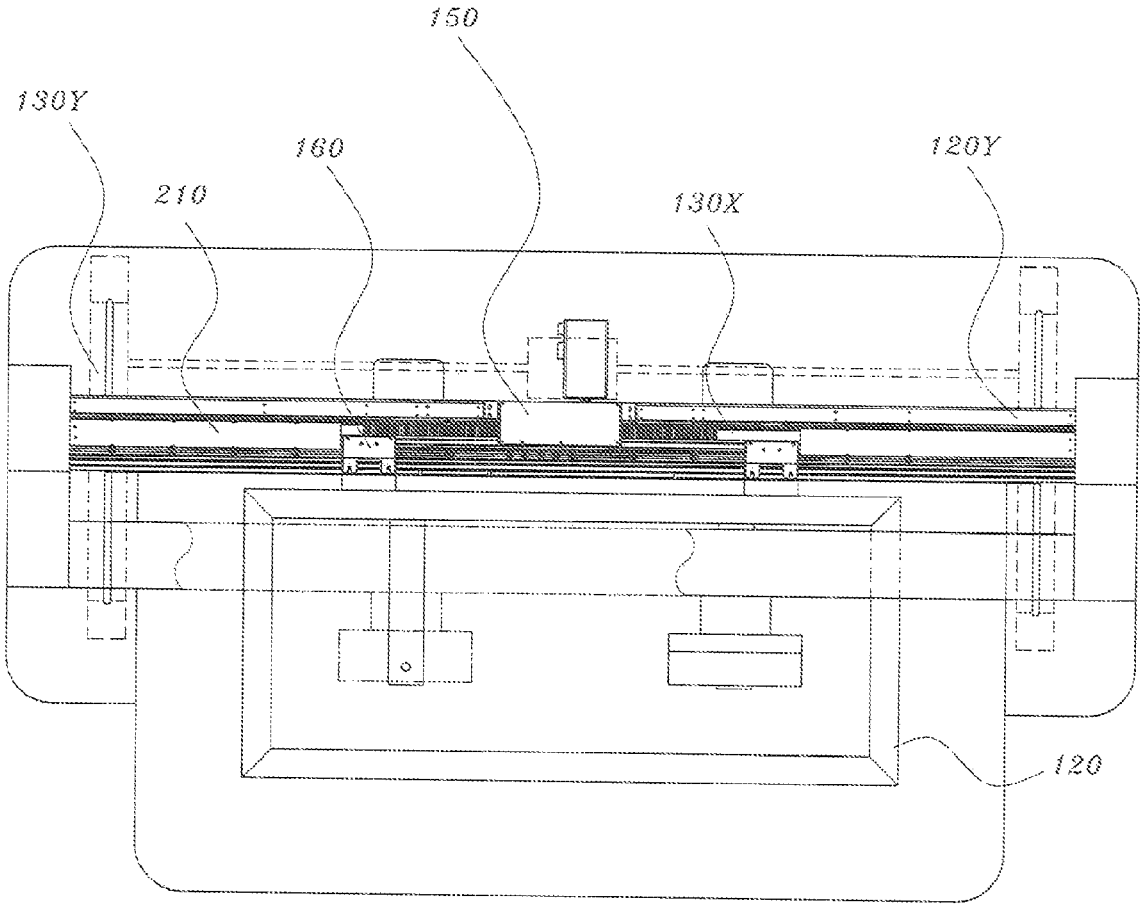
FIG. 9 is a view illustrating a driving apparatus of an embroidery frame of a sewing machine according to a fourth embodiment of the present invention.

FIG. 9 is a view illustrating a driving apparatus of an embroidery frame of a sewing machine according to a fourth embodiment of the present invention.

The driving apparatus of an embroidery frame of a sewing machine according to the fourth embodiment of the present invention, as illustrated in FIG. 9, includes a Y-directional frame driving unit 120Y installed at a side of a movable frame of the Y-directional movement mechanism 130Y to move the embroidery frame 120 in the Y-direction, an X-directional movement mechanism 130X installed at a side of the Y-directional frame driving unit 120Y to be moved in the Y-direction to move the embroidery frame 120 in the X-direction, and a connecting body 160 connected to the movable frame of the X-direction movement mechanism 130X to detachably fix the embroidery frame 120. In this case, in the X-directional movement mechanism 130X, the movable frame of the X-directional movement mechanism 130X is installed at a side of the Y-directional frame driving unit 120Y, and a movable frame driving unit 150 is installed in the upper side of the sewing table at the central area of the movable frame of the X-directional movement mechanism 130X. Moreover, the embroidery frame 120 is installed in the upper side of the sewing table and is connected to the movable frame of the X-directional movement mechanism 130X by the connecting body 160 to connect the embroidery frame 120 to be freely detached.

Embodiment 5

FIG. 10 is a view illustrating a driving apparatus of an embroidery frame of a sewing machine according to a fifth embodiment of the present invention, for example, a single-head type embroidery machine or a sewing machine.

The driving apparatus of an embroidery frame according to the fifth embodiment of the present invention, as illustrated in FIG. 10, includes a fixed frame (not shown) installed at a side of a movable frame of a Y-directional movement mechanism 130Y, an X-directional movement mechanism 130X installed at a side of the fixed frame to be moved in the Y-direction to move the embroidery frame 120 in the X-direction, and a connecting body 160 connected to the movable frame of the X-directional movement mechanism 130X to detachably fix the embroidery frame 120. In this case, the embroidery frame 120 is installed in the upper side of the sewing table, is connected to the movable frame of the X-directional movement mechanism 130X by the connecting body 160 to connect the embroidery frame 120 to be freely detached, and is freely moved in the X-direction and the Y-direction by the X-directional movement mechanism 130X and the Y-directional movement mechanism 130Y.

Driving Apparatus of an Embroidery Frame of a Sewing Machine

Figure 11:
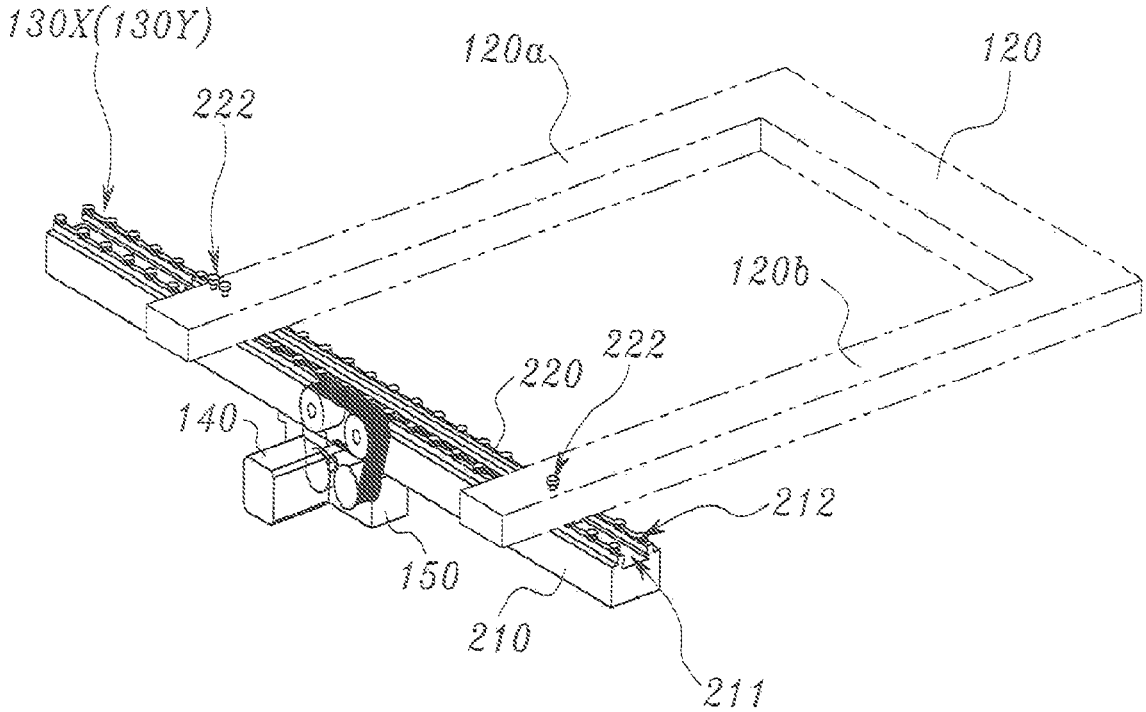
Figure 12:
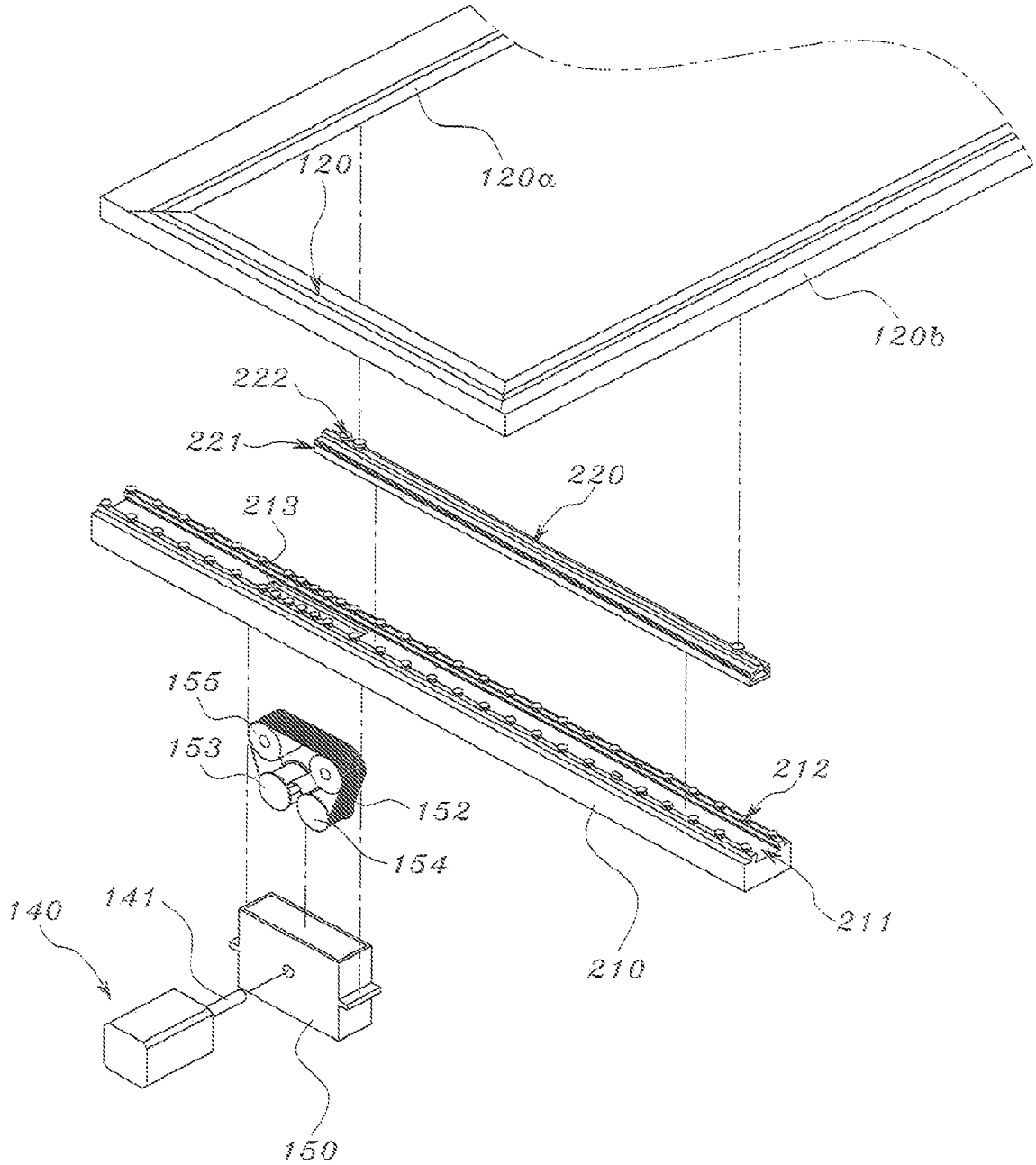
Figure 13A:
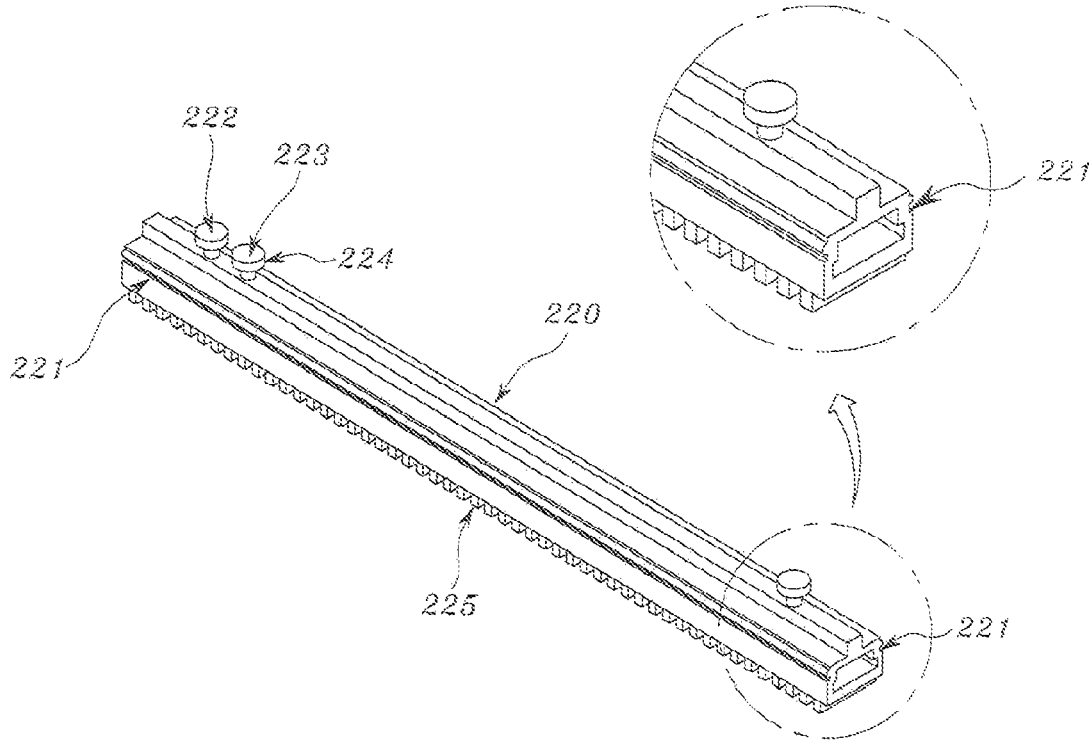
FIGS. 13A and 13B are views respectively illustrating the structure of the movable frames.
Figure 13B:
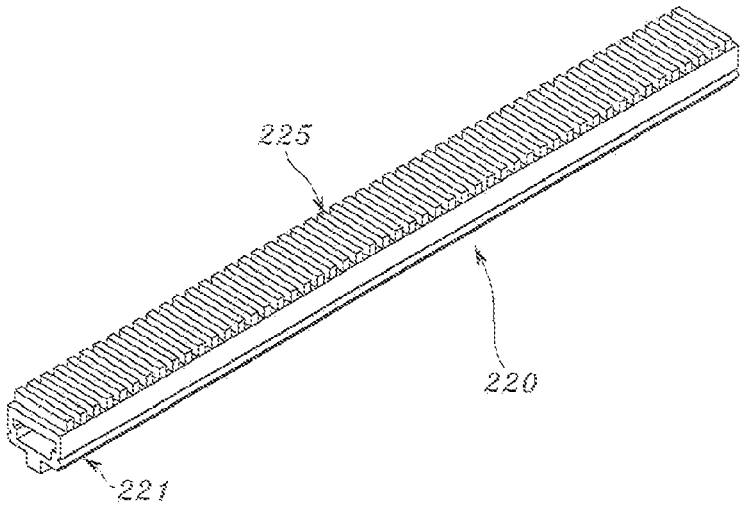
Figure 14:
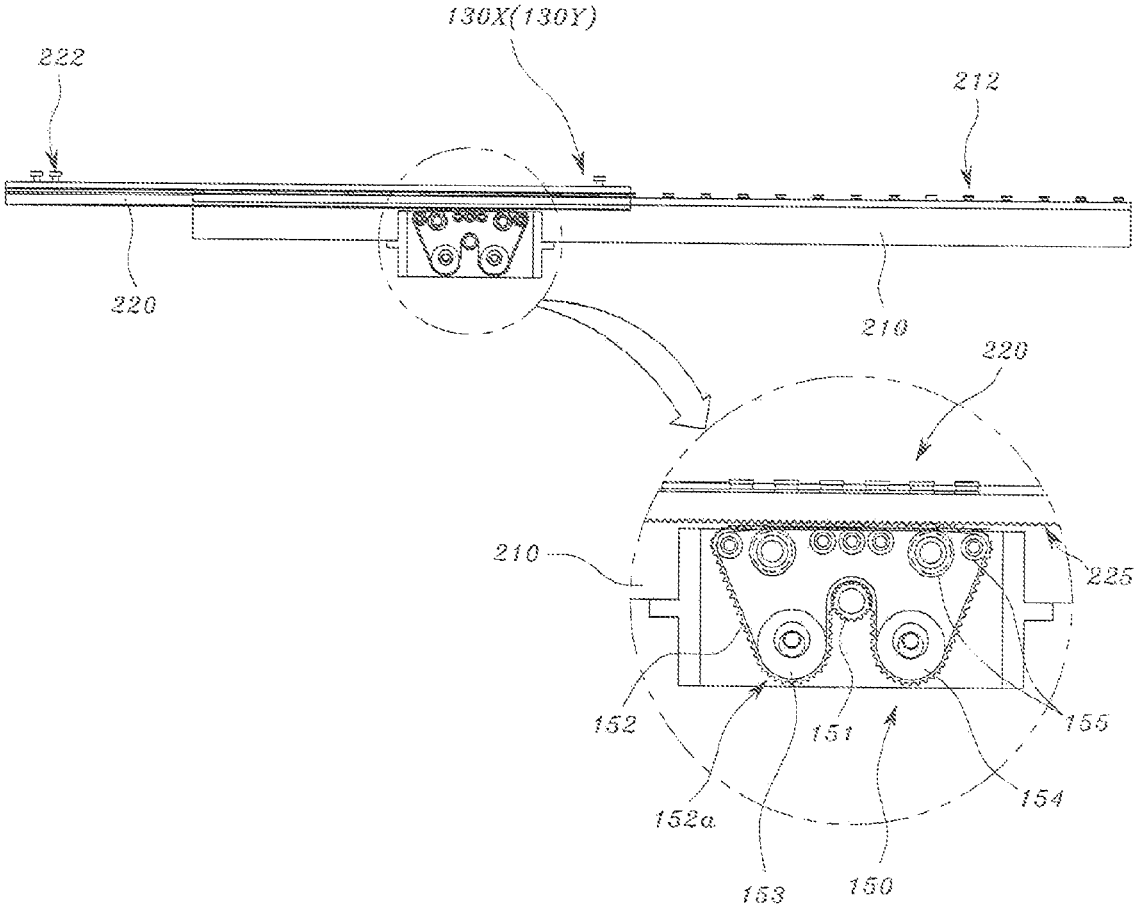

FIGS. 11 to 14 are views illustrating a driving apparatus of an embroidery frame employed in the embodiments of the present invention, in which: FIG. 11 is a view illustrating the fixed frames 210, the movable frames 220, and the of the movable frame driving units 150 of the X-directional movement mechanism 130X and the Y-directional movement mechanism 130Y, FIG. 12 is an exploded perspective view illustrating the driving apparatus of an embroidery frame, FIGS. 13A and 13B are views respectively illustrating the structure of the movable frames, and FIG. 14 is a view illustrating rack-shaped gear teeth and the movable frame driving unit 150.

Each of the X-directional movement mechanism 130X and the Y-direction movement mechanism 130Y, as illustrated in FIGS. 11 to 14, includes a single fixed frame 210 fixed to a beam-body of the sewing machine, a movable frame 220 installed on the fixed frame 210 and having gear teeth 225 formed in the lower side thereof, a movable frame driving unit 150 engaged with the gear teeth 225 formed in the lower side of the movable frame 220 to reciprocate the movable frame 220, and a driving motor 140 to supply a driving force to the movable frame driving unit 150.

Here, the fixed frame 210, as illustrated, includes a guide rail 211 installed long in the upper side of the fixed frame 210 along a longitudinal axis, and a plurality of track rollers 212 provided at both sides of the guide rail 211 to be spaced apart from each other.

Moreover, the movable frame 220 includes a guide rail 221 installed long at the lateral sides of the movable frame 220 along a longitudinal axis to be supported by the track rollers 212 of the fixed frame 210, and a rail guide member 222 installed on the movable frame 220 to guide the embroidery frame to move in the direction perpendicular to the movable frame 220.

Moreover, the movable frame driving unit 150, as illustrated in FIG. 14, includes an engaging member 152 engaged with the gear teeth 225 formed in the lower side of the movable frame 220, rotation members 153 to 155 having a plurality of idlers to support the engaging member 152, and a driving body 151 to provide a rotation force to the engaging member 152 by the driving force of the driving motor 140. In this case, the driving body 151 is a driving pulley as a driving gear having gear teeth engaged with the gear teeth 225 of the engaging member 152.

Preferably, the engaging member 152 is a belt-type power transmitting member and the driving body 151 is a driving pulley. In this case, the belt-type power transmitting member is implemented by a timing belt having gear teeth 152*a* engaged with the gear teeth 225 formed in the lower side of the movable frame 220. Although the timing belt type engaging member 152 has the gear teeth 152 formed at a side thereof to be engaged with the gear teeth 225 formed in the lower side of the movable frame 220, the engaging member 152 may have an opposite side to contact the rotation members 153 to 155 and to be integrated with a friction member to increase rolling friction.

The movable frame driving unit 150 is configured such that the engaging member 152 is supported and rotated by the rotation members 153 to 155 having the plurality of idlers. In this case, the driving body 151 between the two rotation members 153 and 154, as illustrated in FIG. 14, is positioned upper than the two rotation members 153 and 154 and has gear teeth engaged with the gear teeth 152*a* of the engaging member 152. Thus, since the engaging member 152 is engaged with the gear teeth to rotate, the engaging member 152 does not slip during the rotation but precisely transmits the rotational force and enables a high-speed rotation.

On the other hand, the engaging member 152 can be implemented by a power transmitting member different from the belt-type power transmitting member. For example, a rack and a pinion are used or a chain-type power transmitting member is used to implement the engaging member 152.

Moreover, as another example, the movable frame driving unit 150 may include an engaging member (not shown) engaged with the gear teeth 225 formed in the lower sides of the movable frame 220, and a driving body to provide the rotational force to the engaging member by the driving force of the driving motor 140. In this case, preferably, a pinion may be used as the engaging member and a driving pulley may be used as the driving body.

The Y-directional movement mechanism 130Y of an embroidery frame of a sewing machine according to the embodiment of the present invention is configured such that the guide rail to guide the movable frame 220 in the Y-axis (front-to-rear) direction is coupled with the upper side of the fixed frame 210 fixed to the beam-body of the sewing machine together with a bearing, the lateral side ends of the movable frame 220 are coupled with the guide rail and the bearing to slide along the guide rail in the Y-axis direction, and Y-directional front and rear horizontal frames 120*a* and 120*b* of the embroidery frame 120 are respectively placed on the front and rear upper sides of the movable frame 220.

In this case, the movable frame driving unit 150, connected to the driving motor 140 to provide a movement driving force of moving the embroidery frame 120 in the Y-axis (front-to-rear) direction, is installed at approximately central portion of the lower side of the fixed frame 210. In the movable frame driving unit 150, the driving body (or driving gear) 151 fitted around the outer circumference of a driving shaft 141 of the driving motor 140 is mounted, and the engaging member 152, to convert the rotational driving force of the driving motor 140 into a linear driving force, is wound around the outer circumferences of the plural rotation members 153 to be engaged with the gear teeth 221 formed in the lower side of the movable frame 220.

As the plural rotation members 153, rotation members such as a pulley, a gear, and the like may be used.

In more detail, the principle of the movement operation of the embroidery frame will be described. In the Y-directional movement mechanism 130Y, when the driving motor 140 rotates forward and backward in accordance with the Y-axis movement data, the forward and backward rotational driving force of the driving motor 140 is converted into the Y-axis linear driving force by the driving gear 151 and the engagement between the plural rotation members 153 to 155 and the engaging member 152, and the converted linear driving force is transmitted to the movable frame 220, the embroidery frame 120 placed on and fixed to the movable frame 220 is moved in the Y-axis direction.

In other words, the gear teeth 221 formed in the lower side of the movable frame 220 are engaged with the gear teeth 152*a* of the engaging member 152 to move the embroidery frame 120 along the guide rail installed in the fixed frame 210 in the Y-axis (front-to-rear) direction.

On the other hand, the number of the Y-directional movement mechanism 130Y may be plural in accordance with the size of the embroidery frame.

In the embodiments of the present invention, although the movement mechanism of an embroidery frame has been described using the Y-directional movement mechanism 130Y, the Y-directional movement mechanism 130Y is not limited to the above-described embodiments but can be applied to the X-directional movement mechanism 130X.

In other words, the X-directional movement mechanism 130X of an embroidery frame of a sewing machine is configured such that the guide rail to guide the movable frame 220 in the X-axis (right-to-left) direction is mounted to the upper side of the fixed frame 210 fixed to the beam-body of the sewing machine together with the bearing, the both lateral ends of the movable frame 220 are coupled with the guide rail and the bearing to slide along the guide rail in the X-direction, and the X-directional front and rear vertical frames of the embroidery frame 120 are respectively placed on the front and rear upper sides of the movable frame 220.

In this case, the movable frame driving unit 150, connected to the driving motor 140 to provide a movement driving force of moving the embroidery frame 120 in the X-axis (right-to-left) direction, is installed at approximately central portion of the lower side of the fixed frame 210. In the movable frame driving unit 150, the driving body (or driving gear) 151 fitted around the outer circumference of a driving shaft 141 of the driving motor 140 is mounted, and the engaging member 152, to convert the rotational driving force of the driving motor 140 into a linear driving force, is wound around the outer circumferences of the plural rotation members 153 to be engaged with the gear teeth 221 formed in the lower side of the movable frame 220.

As the plural rotation members 153, rotation members such as a pulley, a gear, and the like may be used.

In more detail, the principle of the movement operation of the embroidery frame will be described. In the X-directional movement mechanism 130X, when the driving motor 140 rotates forward and backward in accordance with the X-axis movement data, the forward and backward rotational driving force of the driving motor 140 is converted into the X-axis linear driving force by the driving gear 151 and the engagement between the plural rotation members 153 to 155 and the engaging member 152, and the converted linear driving force is transmitted to the movable frame 220, the embroidery frame 120 placed on and fixed to the movable frame 220 is moved in the X-axis direction.

In other words, the gear teeth 221 formed in the lower side of the movable frame 220 are engaged with the gear teeth 152*a* of the engaging member 152 to move the embroidery frame 120 along the guide rail installed in the fixed frame 210 in the X-axis (right-to-left) direction.

On the other hand, the number of the X-directional movement mechanism 130X may be plural in accordance with the size of the embroidery frame.

Power Transmission

A rack and pinion type power transmission according to an embodiment of the present invention will be described with reference to FIG. 14. The rack and pinion type power transmission includes a rack formed with gear teeth, an engaging member engaged with the gear teeth of the rack, a plurality of rotation member to support the engaging member to rotate, and a driving body to provide a rotational force to the engaging member.

Here, the plurality of rotation member supports the engaging member to rotate in the form of a trapezoidal shape. The driving body is positioned between two rotation members, among the plural rotation members to form the trapezoidal shape, installed at the positions higher than rotation shafts of the rotation members positioned at the lower side and at the lower side. The engaging member has a side having a reversed U-shape formed by the driving body installed between the two rotation members.

Here, preferably, the engaging member is a belt type power transmitting member and the driving body is a driving pulley. The belt type power transmitting member includes gear teeth formed in a side thereof and engaged with the gear teeth formed in the lower side of the movable frame. In this case, the belt type power transmitting member may include a frictional member provided at the opposite side to increase the rotational friction against the rotation members.

Moreover, the plural rotation members are implemented by idlers and the driving body includes gear teeth engaged with the engaging member.

Moreover, a chain type power transmitting member may be used as the engaging member and a driving pulley may be used as the driving body.

On the other hand, a power source to provide the driving force to the movement mechanisms of the embroidery frame described in the embodiments of the present invention may be individually installed to the movable frame movement mechanisms, or may use a single common driving motor such that a single output shaft is connected to plural driving boxes to drive the movable frame.

Here, the engaging member installed in the movable frame movement mechanism may be a belt type power transmitting member such as a timing belt, a chain, or a driven gear directly engaged with the driving body.

Moreover, the driving body installed in the movable frame movement mechanism and connected to the power source includes all of devices and units to transmit the driving force of the power source such as a timing pulley, a sprocket, a driving gear, a driving pulley, and the like.

Furthermore, the above-described driving apparatus of an embroidery frame of a sewing machine can be applied to every sewing machine to which the Y-directional movement mechanism or the X-directional movement mechanism is applied.

The movable frame 220 employed in the present invention may include a plurality of track rollers 212 disposed at the lateral sides thereof at a regular interval, and the rail guide member 222 installed in the upper side to guide the embroidery frame 120 in the direction perpendicular to the movable frame 220. The fixed frame 210 preferably includes the guide rail 222 installed long in the upper lateral sides of the fixed frame 210 along a longitudinal axis to be supported and moved by the track rollers 212 of the movable frame 220, and an insertion hole 213 into which the movable frame movement mechanism is inserted to be engaged with the movable frame 220. In this case, the rail guide member 222 is preferably implemented by a roller.

As described above, according to the rack and pinion type power transmission of the present invention and the driving apparatus of an embroidery frame of a sewing machine, the gear teeth, which are engaged with the engaging member connected to the power source, are formed in the lower side of the a single movable frame, to which the embroidery frame is fixed and supported, so as to directly move the movable frame, so that the uniform driving force can be transmitted to the front and rear side of the embroidery frame during the X- or Y-directional movements of the embroidery frame. Thus, the high reliable and steady movement can be carried out.

In other words, according to the conventional art, when the movement distance is elongated or the strength of the connecting member is weak, the embroidery frame, which is placed on the connecting member to connect two movable frames to each other to be moved, is vibrated during the movement so that the embroidery product is deteriorated. On the contrary, according to the present invention, the front and rear long horizontal frames of the embroidery frame on the single movable frame are integrally formed with the single fixed frame to be moved, so that the uniform driving force can be transmitted to overall embroidery frame and the deterioration of the embroidery product caused by the vibration of the embroidery frame during the movement of the embroidery frame can be also prevented.

Moreover, the X-directional movement mechanism can achieve the same effect as described above.

Furthermore, the precision, the high-speed operation, and the durability of the embroidery frame can be achieved, as well, it is possible to minimize the increase of the number of components, costs, and driving noise, to prevent the deflection of the embroidery frame, and to achieve the precise operation of the embroidery frame even when driving a large sized embroidery frame.

Figure 15:
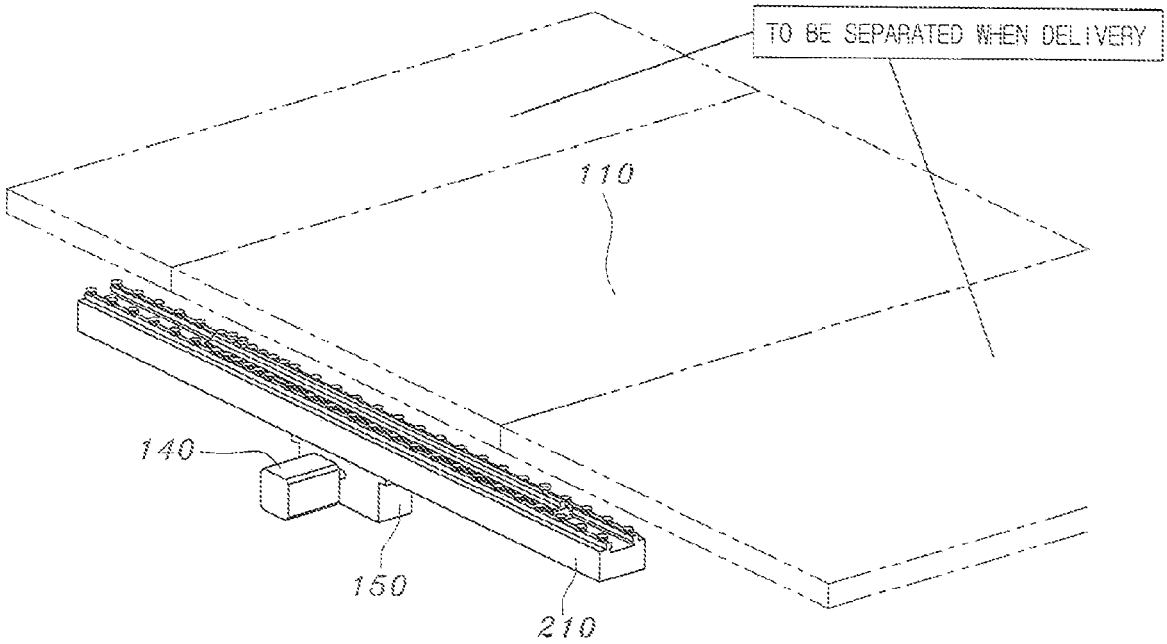
FIG. 15 is a view illustrating advantage of the driving apparatus of an embroidery frame according to the embodiment of the present invention.

Moreover, in the conventional driving apparatus of an embroidery frame, since the power source (driving motor) to drive the embroidery frame is positioned at an end of the beam-body, the table positioned at the front side must be separated in order to decrease the size of the sewing machine when carrying the sewing machine. However, according to the present invention, since the power source (driving motor) to drive the embroidery frame is mounted at the intermediate portion of the beam-body, the front and rear tables can be separated when carrying the sewing machine (See FIG. 15) to be easily accommodated in a container (a packaging space is minimized).

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A driving apparatus of an embroidery frame of a sewing machine, comprising:

at least one X-directional movement mechanism to move the embroidery frame to support an object to be embroidered in right-to-left direction (X-direction); and at least one Y-directional movement mechanism to move the embroidery frame to support an object to be embroidered in front-to-rear direction (Y-direction), wherein any one of the X-directional movement mechanism and the Y-directional movement mechanism comprising:

a fixed frame installed to a beam-body of the sewing machine;

a movable frame movably installed on the fixed frame and having gear teeth; and a movable frame movement mechanism engaged with the gear teeth formed in the movable frame to reciprocate the movable frame, wherein the fixed frame further comprises:

an insertion hole into which the movable frame movement mechanism is inserted to be engaged with the movable frame.

2. A driving apparatus of an embroidery frame of a sewing machine, comprising:

at least one X-directional movement mechanism to move the embroidery frame to support an object to be embroidered in right-to-left direction (X-direction); and at least one Y-directional movement mechanism to move the embroidery frame to support an object to be embroidered in front-to-rear direction (Y-direction), wherein each of the X-directional movement mechanism and Y-directional movement mechanism comprising:

a fixed frame installed to a beam-body of the sewing machine;

a movable frame movably installed on the fixed frame and having gear teeth; and a movable frame movement mechanism engaged with the gear teeth formed in the movable frame to reciprocate the movable frame, wherein the fixed frame further comprises:

an insertion hole into which the movable frame movement mechanism is inserted to be engaged with the movable frame.

3. The driving apparatus of an embroidery frame of a sewing machine as claimed in claim 1 or 2, wherein the fixed frame comprises a plurality of track rollers provided at the lateral sides by a regular interval.

4. The driving apparatus of an embroidery frame of a sewing machine as claimed in claim 3, wherein the movable frame comprises:

guide rails installed long along the longitudinal axis at the lateral sides of the movable frame to be supported and moved by the track rollers of the fixed frame; and a rail guide member installed in the upper side of the movable frame to guide the embroidery frame in the direction perpendicular to the movable frame.

5. The driving apparatus of an embroidery frame of a sewing machine as claimed in claim 4, wherein the rail guide member comprises a roller.

6. The driving apparatus of an embroidery frame of a sewing machine as claimed in claim 1 or 2, wherein the movable frame comprises:

a plurality of track rollers provided at the lateral sides of the movable frame by a regular interval; and a rail guide member installed in the upper side of the movable frame to guide the embroidery frame in the direction perpendicular to the movable frame.

7. The driving apparatus of an embroidery frame of a sewing machine as claimed in claim 6, wherein the fixed frame comprises:

guide rails installed long along the longitudinal axis at the lateral sides of the fixed frame to be supported and moved by the track rollers of the movable frame; and an insertion hole into which the movable frame movement mechanism is inserted to be engaged with the movable frame.

8. The driving apparatus of an embroidery frame of a sewing machine as claimed in claim 6, wherein the rail guide member comprises a roller.

9. The driving apparatus of an embroidery frame of a sewing machine as claimed in claim 1 or 2, wherein the movable frame movement mechanism comprises:

an engaging member engaged with the gear teeth formed in the lower side of the movable frame;

a plurality of rotation members to rotatably support the engaging member; and a driving body to provide a rotational force to the engaging member.

10. The driving apparatus of an embroidery frame of a sewing machine as claimed in claim 9, wherein the plurality of rotation members supports the engaging member, the driving body is positioned between rotation members among the plural rotation members installed at the positions higher than rotation shafts of the rotation members positioned at the lower side and at the lower side, and the engaging member has a reversed U-shape formed by the driving body installed between the two rotation members.

11. The driving apparatus of an embroidery frame of a sewing machine as claimed in claim 9, wherein the engaging member comprises a belt-type member.

12. The driving apparatus of an embroidery frame of a sewing machine as claimed in claim 11 wherein a belt-type member includes gear teeth engaged with the gear teeth formed in the movable frame.

13. The driving apparatus of an embroidery frame of a sewing machine as claimed in claim 9, wherein the plurality of rotation members comprises idlers.

14. The driving apparatus of an embroidery frame of a sewing machine as claimed in claim 9, wherein the driving body comprises gear teeth engaged with the engaging member.

15. The driving apparatus of an embroidery frame of a sewing machine as claimed in claim 9, wherein the engaging member comprises a chain-type member.

16. The driving apparatus of an embroidery frame of a sewing machine as claimed in claim 1 or 2, wherein the movable frame movement mechanism comprises:

an engaging member engaged with the gear teeth formed in the lower side of the movable frame; and a driving body to provide a rotational force to the engaging member.

17. The driving apparatus of an embroidery frame of a sewing machine as claimed in claim 1 or 2, wherein front and rear horizontal frames are coupled with a side of the movable frame.

18. The driving apparatus of an embroidery frame of a sewing machine as claimed in claim 1 or 2, further comprising one of an X-directional frame driving unit provided at a side of the movable frame of the X-directional movement mechanism to move the embroidery frame in the X-direction, and a Y-directional frame driving unit provided at a side of the movable frame of the Y-directional movement mechanism to move the embroidery frame in the Y-direction.

19. The driving apparatus of an embroidery frame of a sewing machine as claimed in claim 1 or 2, further comprising:

an X-directional frame driving unit provided at a side of the movable frame of the X-directional movement mechanism to move the embroidery frame in the X-direction; and a Y-directional frame driving unit provided at a side of the movable frame of the Y-directional movement mechanism to move the embroidery frame in the Y-direction.

20. The driving apparatus of an embroidery frame of a sewing machine as claimed in claim 1 or 2, further comprising:

an X-directional frame driving unit to move the embroidery frame in the X-direction by the movable frame of the X-directional movement mechanism;

a Y-directional frame driving unit to move the embroidery frame in the Y-direction by the movable frame of the Y-directional movement mechanism;

an X-Y-directional frame driving unit connected to the X-directional movement mechanism and the Y-directional movement mechanism to move the embroidery frame in the X-direction and in the Y-direction; and a connecting body connected to the X-Y-directional frame driving unit to detachably fix the embroidery frame.

21. The driving apparatus of an embroidery frame of a sewing machine as claimed in claim 1 or 2, further comprising:

a Y-directional frame driving unit provided at a side of the movable frame of the Y-directional movement mechanism to move the embroidery frame in the Y-direction;

an X-directional frame driving unit provided at a side of the Y-directional frame driving unit to be moved in the Y-direction and to move the embroidery frame in the X-direction; and a connecting body connected to the movable frame of the X-directional movement mechanism to detachably fix the embroidery frame.

22. The driving apparatus of an embroidery frame of a sewing machine as claimed in claim 21, wherein the movable frame driving unit is installed in the upper side of the sewing table at the central area of the movable frame of the Y-directional movement mechanism.

23. The driving apparatus of an embroidery frame of a sewing machine as claimed in claim 22, wherein the movable frame of the X-directional movement mechanism comprises upwardly formed gear teeth.

24. The driving apparatus of an embroidery frame of a sewing machine as claimed in claim 1 or 2, further comprising:

a fixed frame installed at a side of the movable frame of the Y-directional movement mechanism;

an X-directional movement mechanism installed at a side of the fixed frame to be moved in the Y-direction and to move the embroidery frame in the X-direction; and a connecting body connected to the movable frame of the X-directional movement mechanism to detachably fix the embroidery frame.

25. The driving apparatus of an embroidery frame of a sewing machine as claimed in claim 24, wherein the movable frame driving unit is installed in the upper side of the sewing table at the central area of the fixed frame.

26. The driving apparatus of an embroidery frame of a sewing machine as claimed in claim 24, wherein the movable frame of the X-directional movement mechanism comprises upwardly formed gear teeth.

27. The driving apparatus of an embroidery frame of a sewing machine as claimed in claim 1 or 2, wherein individual driving sources are installed to respective movable frame movement mechanisms.

28. The driving apparatus of an embroidery frame of a sewing machine as claimed in claim 1 or 2, wherein the movable frame movement mechanism is driven by a single driving source.

29. The driving apparatus of an embroidery frame of a sewing machine as claimed in claim 1 or 2, wherein the movable frame movement mechanism is installed at the intermediate portion in the longitudinal direction of the fixed frame.

30. The driving apparatus of an embroidery frame of a sewing machine as claimed in claim 1 or 2, wherein the beam-body of the sewing machine comprises a table.

31. A power transmission comprising:

a rack formed with gear teeth;

an engaging member engaged with the gear teeth of the rack;

a plurality of rotation member to rotatably support the engaging member; and a driving body to provide a rotational force to the engaging member, wherein the plurality of rotation members supports the engaging member, the driving body is positioned between rotation members among the plural rotation members installed at the positions higher than rotation shafts of the rotation members positioned at the lower side and at the lower side, and the engaging member has a reversed U-shape formed by the driving body installed between the two rotation members.

32. The power transmission as claimed in claim 31, wherein the engaging member comprises a belt-type member.

33. The power transmission as claimed in claim 31, wherein a belt-type member includes gear teeth engaged with the gear teeth formed in the rack.

34. The power transmission as claimed in claim 31, wherein the plurality of rotation members comprises idlers.

35. The power transmission as claimed in claim 31, wherein the driving body comprises gear teeth engaged with the engaging member.

36. The power transmission as claimed in claim 31, wherein the engaging member comprises a chain-type member.

* * * * *